US006857409B2

(12) United States Patent
Ito et al.

(10) Patent No.: US 6,857,409 B2
(45) Date of Patent: Feb. 22, 2005

(54) AIR INTAKE SYSTEM FOR ENGINE

(75) Inventors: Atsushi Ito, Anjo (JP); Shigeru Katsuragi, Anjo (JP); Futaba Kanehira, Anjo (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 33 days.

(21) Appl. No.: 10/400,787

(22) Filed: Mar. 28, 2003

(65) Prior Publication Data

US 2003/0221651 A1 Dec. 4, 2003

(30) Foreign Application Priority Data

Mar. 28, 2002 (JP) ..... 2002-092960

(51) Int. Cl.[7] ..... F02M 35/10

(52) U.S. Cl. ..... 123/184.42; 123/184.61; 29/890.08

(58) Field of Search ..... 123/184.42, 184.61; 29/890.052, 890.08

(56) References Cited

U.S. PATENT DOCUMENTS 5,003,933 A * 4/1991 Rush et al. ..... 123/184.42
5,392,742 A * 2/1995 Rush et al. ..... 123/184.61
5,636,605 A * 6/1997 Nomizo et al. ..... 123/184.61
5,713,323 A * 2/1998 Walsh et al. ..... 123/184.42

FOREIGN PATENT DOCUMENTS

JP 6-142905 A 5/1994
JP 11-182367 A 7/1999

* cited by examiner

*Primary Examiner*—Andrew M. Dolinar
*Assistant Examiner*—Katrina B. Harris
(74) *Attorney, Agent, or Firm*—Burns, Doane, Swecker & Mathis, L.L.P.

(57) ABSTRACT

An air intake system which includes a first member, a second member connected to the first member for forming an air intake passage for introducing an intake air from an upstream mechanism of an engine to cylinders of the engine, a first convex portion provided on either one of the first member or the second member, and a groove portion for forming a clearance by engaging with the convex portion on the other of the second member or the first member. The liquid sealing agent is charged into the clearance.

11 Claims, 4 Drawing Sheets

AIR INTAKE SYSTEM FOR ENGINE

This application is based on and claims priority under 35 U.S.C. §119 with respect to Japanese Application No. 2002-092960 filed on Mar. 28, 2002, the entire content of which is incorporated herein by reference.

FIELD OF THE INVENTION

The present invention generally relates to air intake systems. More particularly, the present invention pertains to an air intake system with light weight for distributing intake air to each cylinder of an engine.

BACKGROUND OF THE INVENTION

A known air intake system with light weight is disclosed in Japanese Patent Laid-Open Publication No. H11-182367. The known intake manifold disclosed in Japanese Patent Laid-Open Publication No. H11-182367 includes a plurality of curved cylindrical distribution pipes which are unitary formed by injection molding with resin.

Another known air intake system with light weight is disclosed in Japanese Patent Laid-Open Publication No. H06-142905. With the air intake system disclosed in Japanese Patent Laid-Open Publication No. H06-142905, a main body portion is produced by aluminum casting, pipes are produced as individual members with aluminum stretched material, and the body portion and the pipes are assembled by welding.

Notwithstanding, according to the known intake manifold having the distribution pipes unitary formed by injection molding with resin, it is required to prepare a core consumed for producing every product, the core being made of precious low temperature melting metal in order to form cylinders. This increases the manufacturing cost. In addition, it is difficult to ensure the rigidity when the entire intake manifold is made of resin, and thus the resin-made intake manifold is susceptible to be influenced by the engine vibration, which causes large vibration noise.

On the other hand, with the known intake manifold made of aluminum, welding for assembling each member increases the manufacturing cost.

A need thus exists for an air intake system including an intake manifold with light weight and with high rigidity without being provided with a precious core and with low assembly cost.

SUMMARY OF THE INVENTION

In light of the foregoing, the present invention provides an air intake system which includes a first member, a second member connected to the first member for forming an air intake passage for introducing an intake air from an upstream mechanism of an engine to cylinders of the engine, a first convex portion provided on either one of the first member or the second member, and a groove portion for forming a clearance by engaging with the convex portion on the other of the second member or the first member. The liquid sealing agent is charged into the clearance.

According to another aspect of the present invention, a method for constructing an air intake system includes a first member, a second member connected to the first member for forming an air intake passage for introducing an intake air from an upstream mechanism of an engine to cylinders of the engine, a convex portion provided on either one of the first member or the second member, and a groove portion for forming a clearance by engaging with the convex portion on the other of the second member or the first member. The method for constructing the air intake system includes process of assembling the first member and the second member, assembling the groove portion and the convex portion for forming the clearance therebetween, and charging liquid sealing agent into the clearance when assembling the first member and the second member.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements.

DETAILED DESCRIPTION OF THE INVENTION

Figure 1:
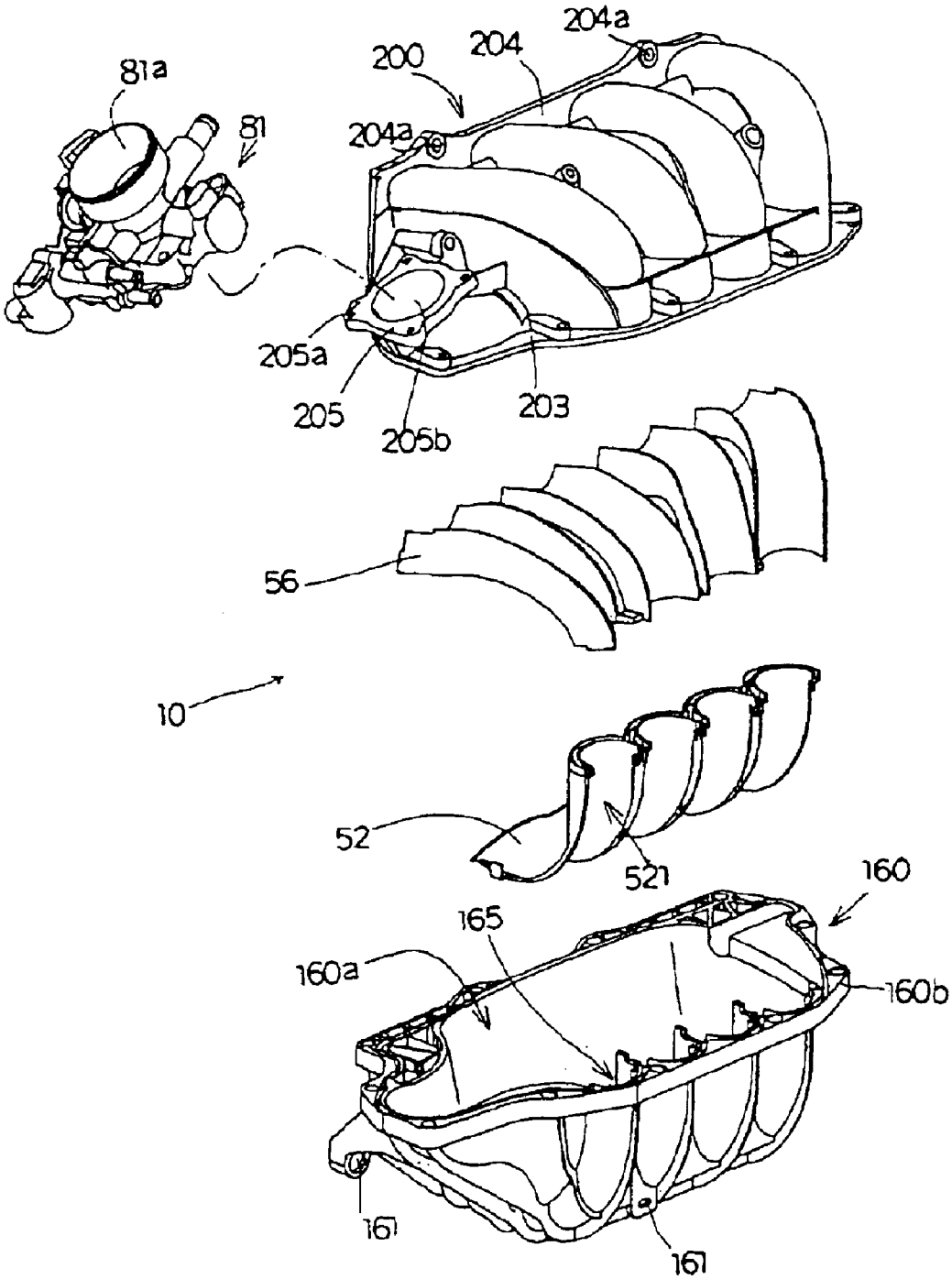
FIG. 1 is an exploded perspective view of an intake manifold according to an embodiment of the present invention.

One embodiment of an air intake system according to the present invention will be explained with reference to the illustrations of the drawing figures.

As shown in FIG. 1, an intake manifold 10 (i.e., serving as an air intake system) for introducing an intake air of an engine includes an upper intake manifold 200 for constructing an outer construction of the intake manifold and a lower intake manifold 160 connected to the upper intake manifold 200.

Figure 2:
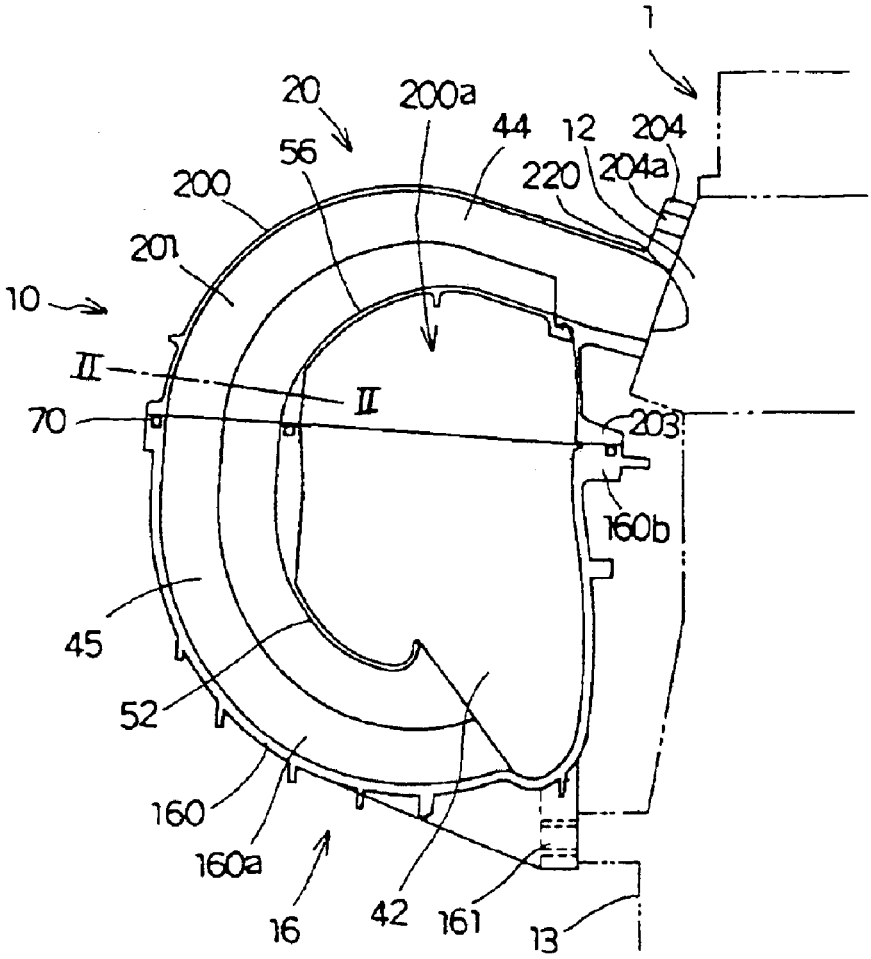
FIG. 2 is a cross-sectional view of the intake manifold taken on line II—II of FIG. 3.

As shown in FIG. 2, space 200*a* and space 160*a* are formed in the upper intake manifold 200 and the lower intake manifold 160. Dividing the space 200*a* of the upper intake manifold 200 with an upper inner 56 forms a first air intake passage 44. Dividing the space 160*a* of the lower intake manifold 160 with a lower inner 52 forms a second air intake passage 45. A portion of the space 200*a* and the space 160*a* other than the air intake passages 44, 45 forms a surge tank 42.

The upper intake manifold 200 is made of metal such as aluminum or magnesium and is formed by die casting. The upper intake manifold 200 includes a head flange 204 for assembling the intake manifold 10 to a cylinder head 12 of an engine 1 as shown in FIG. 2. Further, as shown in FIG. 1, the upper intake manifold 200 includes a throttle flange 205 for assembling a throttle body 81 serving as an upstream side device and an upper flange 203 for assembling the lower intake manifold 160 made of resin.

Figure 4:
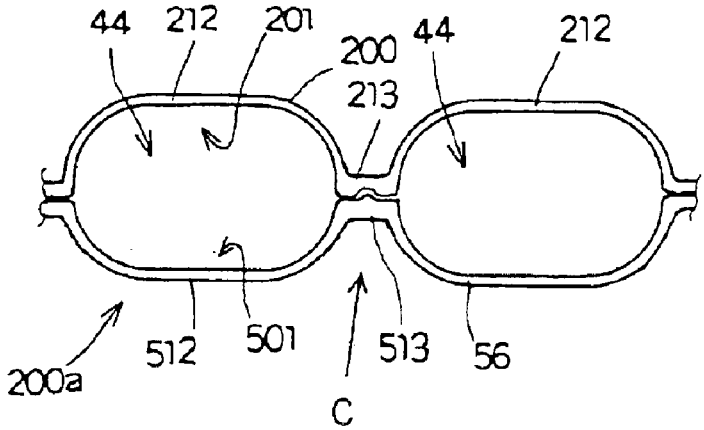
FIG. 4 is a cross-sectional view of the intake manifold taken on line IV—IV of FIG. 2.

As shown in FIGS. 2 and 4, a recess portion 201 heading downward in the illustrations is formed in the space 200*a* of the upper intake manifold 200. The recess portion 201 constructs a upper half of the first air intake passage 44 having an elliptic configuration in cross section. The recess portion 201 is positioned for configuring a streamline of the first air induction system 44 from the head flange 204 to the upper flange 203. Four elliptic ports (not shown) are formed on the head flange 204 and the first air intake passage 44 is in communication with an air intake bore (not shown) of the cylinder head 12.

Because the first air intake passage 44 can be formed by being divided into the upper half of the elliptic configuration, the upper intake manifold 200 can be produced with less manufacturing cost without using the precious and complex core which is made of low temperature melting metal.

As shown in FIG. 4, the upper inner 56 is provided facing the recess portion 201 of the upper intake manifold 200. The upper inner 56 is formed by die casing and a recess portion 501 of a bottom half of the elliptic configuration opposing to the recess portion 201 of the upper intake manifold 200. The recess portion 501 forms the first air intake passage 44 having an oval configuration in cross section along with the recess portion 201. Because the intake manifold 10 according to this embodiment is applied to four-cylinder engine, four first air intake passage 44 are provided. The upper intake manifold 200 and the upper inner 56 are fixed via assembling portions thereon (not shown) to construct an upper intake manifold assembly 20. likewise the upper intake manifold 200, because the upper inner 56 is formed by dividing the elliptic configuration of the first air intake passage 44 in half, a die for die casting can be manufactured with low production cost without using the special complex core.

Figure 5:
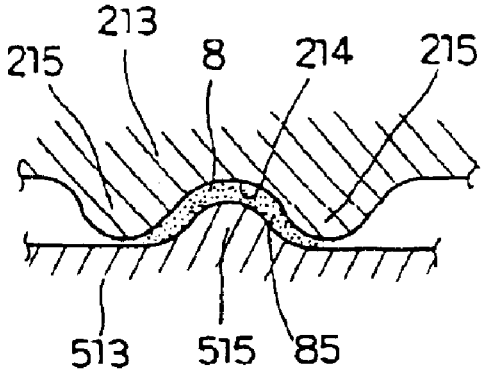
FIG. 5 is a magnified view of a portion C of the intake manifold of FIG. 4.

As shown in FIG. 4, a plane surface portion 213 is formed on the upper intake manifold 200 in the range of each first air intake passage 44 and a plane surface portion 513 is formed on the upper inner 56. As shown in FIG. 5 showing the opposing surfaces of the plane surface potions 213 and 513, the plane surface portion 213 is formed with two convex portions 215 extended along the first air intake passage 44 with a constant interval and a groove portion 214 is formed between convex portions 215. The plane surface portion 513 is formed with a convex portion 515 extended fitting into the groove portion 214. The groove portion 214 and the convex portion 515 are combined to form a clearance 8 therebetween while assembling the upper intake manifold 200 and the upper inner 56. Liquid sealing agent 85 is charged into the clearance 8 when assembling the upper intake manifold 200 and the upper inner 56. The known liquid sealing agent 85 is transformed from the liquid to be the elastic solid body by reacting with the water in the atmosphere after the application.

With the foregoing construction, the assembling of the upper intake manifold 200 and the upper inner 56 does not require the costly assembling method such as welding. The groove portion 214 and the convex portion 515 function for positioning the upper intake manifold 200 and the upper inner 56 when assembling the upper intake manifold 200 and the upper inner 56. As shown in FIG. 5, a relief portion with small gap is provided between an apex of the convex portion 215 and the plane surface portion 513 so that the gap and the roughness for disturbing the flow of the intake air is not generated at the connection portion therebetween regardless of variations of dimensions. Generally known rubber made gasket is susceptible to have the drawbacks that the gasket is projected to the air intake passage due to the displacement of the position during the assembling process. Because this problem caused inside of the intake manifold is hardly visually observed, the resistance for flowing the intake air is significantly increased when the problem stays. With the foregoing construction of the embodiment, the communication between first air intake passages 44 is blocked, the timing of the air intake to each cylinder is strictly managed to stable the combustion of the engine along with a lower intake manifold assembly 16.

As shown in FIG. 1, the throttle body flange 205 includes a screw portion 205*a* for fixing the throttle body 81 and a bore portion 205*b* provided around a center of the throttle flange 205.

As shown in FIGS. 1–2, the space 160*a* of the lower intake manifold 160 is open upwardly and a lower flange 160*b* for assembling the upper intake manifold 200 is provided surrounding the lower intake manifold 160.

With the intake manifold 10 of the embodiment, the lower intake manifold 160 is made of resin and formed by the injection molding. A bottom portion of the space 160*a* of the intake manifold 160 is formed with four half cylindrical recess portions 165 (shown in FIG. 1) for constructing the second air intake passage 45 likewise the upper intake manifold 200. The recess portion 165 is extended along a bottom portion of the space 160*a* having approximately L shape in cross section. Because the second air intake passage 45 having the elliptic configuration is divided in to the recess portion 165 of the half cylindrical portion, the injection molding does not require to prepare the precious core made of low temperature melting metal and the reasonable molding method is applicable.

On the other hand, as further shown in FIG. 1, the lower inner 52 formed by the injection molding of the resin likewise the lower intake manifold 160 is formed with a recess portion 521 which configures the other side of the elliptic configuration divided opposing to the space 160*a*. By assembling the lower intake manifold 160 and the lower inner 52, the elliptic configuration of the second air intake passage 45 is formed. The lower inner 52 is also produced inexpensively by the normal injection molding. Although the explanation is not detailed, a connection portion of the lower intake manifold 160 and the lower inner 52 is provided with a clearance for being charged with the liquid sealing agent to block the communication of the intake air between the second air intake passages 45 likewise the clearance 8 between the upper intake manifold 200 and the upper inner 56. The lower intake manifold 160 and the lower inner 52 are connected at the connection portion (not shown) to construct a lower intake manifold assembly 16.

As shown in FIG. 2, the first air intake passage 44 and the second air induction passage 45 are connected by assembling the upper intake manifold assembly 20 and the lower intake manifold assembly 16. The surge tank 42 is formed by connecting the space 200*a* of the upper intake manifold 200 and the space 160*a* of the lower intake manifold 160 other than the air induction passage. A bottom end of the second air induction passage 45 is opened to the surge tank 42.

Figure 3:
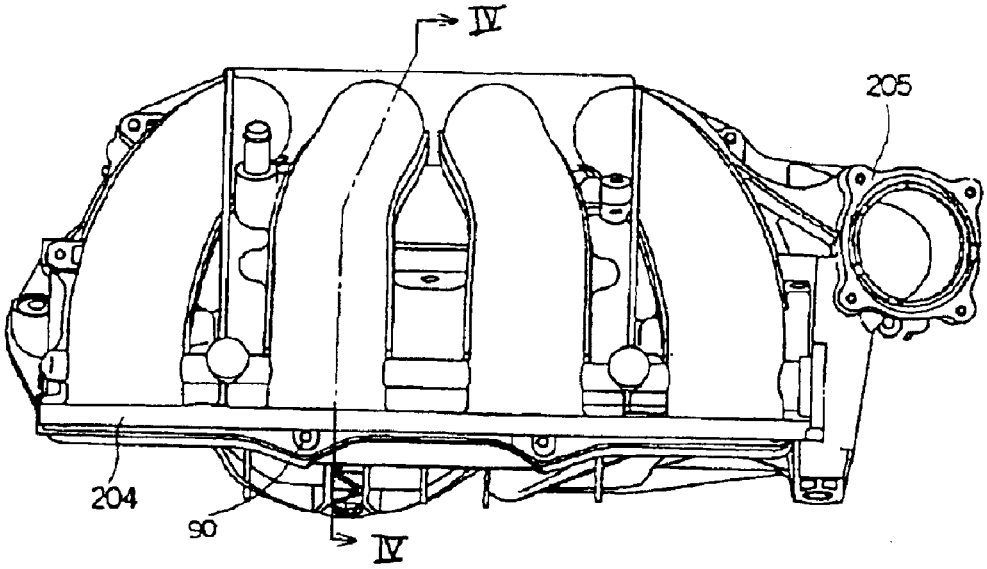
FIG. 3 is a plan view of the intake manifold according to the embodiment of the present invention.

As shown in FIGS. 2–3, the upper intake manifold assembly 20 and the lower intake manifold assembly 16 are assembled with bolts 90 (shown in FIG. 3) via a gasket 70 positioned between the upper flange 203 and the lower flange 160*b*. By assembling the upper intake manifold assembly 20 and the lower intake manifold assembly 16, the first air intake passage 44 and the second air intake passage 45 establish the communication while maintaining the air tightness from the outside. Further, the surge tank 42 is also in communication with the first air intake passage 44 and the second air intake passage 45 while maintaining the air tightness from the outside.

The bottom end of the intake manifold 10 is fixed to the engine 1 side via plural assembling bores 161 formed on the bottom portion of the lower intake manifold 160 as shown in FIG. 2. Thus, the entire rigidity and the strength of the intake manifold 10 are ensured with the foregoing construction.

As foregoing, with the embodiment, the upper intake manifold 200 is made of metal and the throttle body 81 corresponding to the upstream side mechanism with large weight is assembled to the upper intake manifold 200. Thus, the rigidity for assembling relative to the engine vibration of the upstream side mechanism is improved to reduce the noise generated in accordance with the vibration. Although a stay is applied for the reinforcement in order to ensure the vibration resistance of the throttle body with the known device, the member for the reinforcement is not required with the foregoing construction. Thus the number of the parts, the assembling hour, and the manufacturing cost can be reduced.

Although the intake manifold 10 is constructed by combining the parts made of the resin and the parts made of metal, the intake manifold can be constructed regardless of the materials because the parts are simply connected and are not welded. Thus, the intake manifold may be constructed with materials including the steal plate. Because parts are individually formed to be assembled and the liquid sealing agent 85 is charged into the gap between the connection portions of the parts, the materials of the parts can be changed in accordance with the necessity for the vibration of the engine, the weight control, and the manufacturing cost.

Although the upper flange 203 and the lower flange 160*b* are air tightly assembled with the bolt 90 via the gasket 70 with the foregoing embodiment, the upper flange 203 and the lower flange 160*b* may be assembled by charging the liquid sealing agent 85 into the gap therebetween. In this case, it is required to select the sealing made of material without the permeability of the gasoline different from the sealing applied to the inside of the intake manifold 10. Because the constructions are selectable, the degree of freedom for selecting the designing can be increased.

According to the embodiment of the present invention, the first member, the second member, and the division member of the intake manifold are individually manufactured with inexpensive mold. The variation of the dimension is absorbed by providing the convex portion and the concave portion for assembling to ensure the smooth passage and the liquid gasket charged into the gap between the convex portion and the concave portion ensures the sealing performance. Because the precious core is not required for molding the parts and the assembling method requiring expensive equipment and the manufacturing hour such as welding are not required, the intake manifold is manufactured with low production cost. Because the parts may be made of either resin or metal in accordance with the necessity and thus the intake manifold with high weight and high rigidity can be achieved. Further, the degree of freedom for designing is increased because the combinations of the material of the parts can be varied in accordance with the needs.

According to the embodiment of the preset invention, because the first member for supporting the heavy upstream device such as the throttle body is made of metal, the rigidity of the intake manifold for the vibration is ensured and the weight is reduced by forming other parts with resin material. Thus, the vehicle weight is decreased and the noise is reduced.

The principles, preferred embodiment and mode of operation of the present invention have been described in the foregoing specification. However, the invention which is intended to be protected is not to be construed as limited to the particular embodiment disclosed. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. An air intake system comprising:

a first member;

a second member connected to the first member for forming an air intake passage for introducing an intake air from an upstream mechanism of an engine to cylinders of the engine;

the first and second members each having a plane surface;

a first convex portion provided at the plane surface of either one of the first member or the second member; and a groove portion provided at the plane surface of the other of the second member or the first member;

the first convex portion being positioned in the groove portion with a clearance between the first convex portion and the groove portion; and liquid sealing agent in the clearance.

2. An air intake system according to claim 1, wherein either one of the first member or the second member is made of metal.

3. An air intake system according to claim 1, wherein the first member includes one of an upper intake manifold and a lower intake manifold and the second member includes one of an upper inner and a lower inner.

4. An air intake system according to claim 1, wherein either one of the first member or the second member provided with the groove portion includes a second convex portion facing the other of the second member or the first member, and wherein the second convex portion and the plane portion of the other of the second member or the first member provided with the first convex portion forms a clearance therebetween.

5. A method for constructing an air intake system that comprises a first member having a plane surface provided with a convex portion and a second member having a plane surface provided with a groove portion, the method comprising:

assembling the first member and the second member to form an air intake passage for introducing an intake air from an upstream mechanism of an engine to cylinders of the engine;

the first and second members being assembled to position the convex portion in the groove portion with a clearance provided between the convex portion and the groove portion; and charging liquid sealing agent into the clearance when assembling the first member and the second member.

6. An air intake system according to claim 1, wherein the other of the first member and the second member is provided with two second convex portions.

7. An air intake system according to claim 6, wherein the first convex portion extends along the air intake passage with a constant interval.

8. An air intake system according to claim 1, further comprising two second convex portions each disposed on one side of the groove portion.

9. An air intake system according to claim 1, wherein the plane surface of the first member and the plane surface of the second member are spaced apart from one another.

10. A method according to claim 5, further comprising two second convex portions each disposed on one side of the groove portion.

11. A method according to claim 5, wherein the first and second members are assembled so that the plane surface of the first member and the plane surface of the second member are spaced apart from one another.

* * * * *